United States Patent [19]

Wahl

[11] 4,433,786

[45] Feb. 28, 1984

[54] BICYCLE RACK

[76] Inventor: Timothy T. Wahl, 6732 13th Ave. NW., Seattle, Wash. 98117

[21] Appl. No.: 258,921

[22] Filed: Apr. 30, 1981

[51] Int. Cl.[3] ..... E05B 73/00

[52] U.S. Cl. ..... 211/5; 211/17; 211/22

[58] Field of Search ..... 211/5, 17, 20, 22, 24; 248/551, 552, 553; 70/233, 234, 235

[56] References Cited

U.S. PATENT DOCUMENTS

| | | | |
|---|---|---|---|
| D. 233,513 | 11/1974 | Corkill | D12/115 |
| D. 234,587 | 3/1975 | Harris | D12/115 X |
| 3,581,962 | 6/1971 | Osborn | 211/22 X |
| 3,783,659 | 1/1974 | Rossi | 70/234 |
| 3,802,232 | 4/1974 | Mattson et al. | 70/234 |
| 3,815,721 | 6/1974 | Montoya et al. | 211/5 X |
| 3,910,080 | 10/1975 | Dorsey, Jr. | 70/234 |
| 3,964,611 | 6/1976 | Galen et al. | 211/8 X |
| 3,970,197 | 7/1976 | Bale, Jr. | 211/5 |
| 4,126,228 | 11/1978 | Bala et al. | 211/22 X |

*Primary Examiner*—J. Franklin Foss
*Assistant Examiner*—David L. Talbott
*Attorney, Agent, or Firm*—Seed and Berry

[57] ABSTRACT

A novel bicycle rack provides a variety of locking positions which are conveniently available to a bicycle rider who places his bicycle adjacent an elongated panel forming part of the rack. The rack includes at least one convenient locking loop through which the "U" of a shackle lock or a chain may be threaded to secure the bicycle to the rack. The elongated panel provides added protection for the bicycle by limiting the turning radius of the front wheel while cushioning the frame and other bicycle equipment from damage often caused by metal to metal contact on traditional racks. Unlike conventional racks, the wheels are not employed as the main support for holding the bicycle upight, thereby reducing the possibility of damage to the rim or spokes.

12 Claims, 2 Drawing Figures

BICYCLE RACK

DESCRIPTION

1. Technical Field

This invention relates to a novel bicycle rack to which a bicycle may be conveniently locked while the bicycle and its finish are protected. More particularly, this invention relates to a bicycle rack with no moving parts to wear out, no painted finish to renew, and no plastic cushioning to replace. The rack is able to accommodate a bicycle with nearly any lock, supports the bicycle by more than just one wheel, and has a variety of convenient locking positions.

2. Background Art

Traditional bicycle rack designs usually support the bicycle by clasping either the front or rear wheel, thereby exposing the enclosed wheel to damage from lateral forces which can bend and stress the rims and spoking patterns. These traditional racks offer little support for the bicycle frame. Aware of problems presented by traditional bicycle racks, inventors have developed numerous schemes with which to lock bicycles. These schemes fail to recognize that bicycle riders and bicycles often are different and require a variety of options in locking a bicycle adequately. The use of wood to buffer the bicycle's finish and equipment is superior to plastic-based metal dips, paint, coatings, and attachments which do not endure repeated impact of metal bike and lock parts and which may crack under varying weather conditions and which require periodic replacement. Various designs for bicycle racks are disclosed in the following U.S. patents:

U.S. Pat. No. 3,964,611
U.S. Pat. No. 3,910,080
U.S. Pat. No. 4,126,228
U.S. Pat. No. 3,802,232
U.S. Pat. No. 3,783,659
U.S. Pat. No. 3,815,721
U.S. Pat. No. Des. 233,513
U.S. Pat. No. Des. 234,587

DISCLOSURE OF INVENTION

The bicycle rack of this invention, which is used conveniently to lock a bicycle, offers a variety of locking positions, both high security or quick locking options, while providing protection and support for the bicycle through the wood panels. The rack is designed to accommodate a bicycle which has attached to it both front and rear panniers (travel bags). Easy access is provided to the variety of locking positions that the bicycle rider may use. The rack is specifically designed to minimize stooping and squatting on the part of the rider (acts which usually are required to place a "U" lock on commonly available frames and bicycle parking units).

The bicycle is locked to the steel frame adjacent a wooden panel which runs at least as far as the distance between the front fork and rear chain-stay members of the bicycle frame. The panels, therefore, provide a support for the entire side of a bicycle, limiting turning of the front wheel to a small arc, which does not result in protrusion of the front wheel onto pedestrian travel or standing space adjacent the unit. The bicycle is stabilized by the panel, yet access to the locking rack is unimpeded. In the preferred embodiment, at least three options are available for placing a lock to secure the bicycle. The steel support structure of the panel includes an integral locking loop through which the shackle of a "U"-shaped lock or a locked cable or chain may be threaded. Also, a second metal loop is attached to the support to allow greater access and leeway for "U"-shaped locks used at a high position, which minimizes stooping and allows quick locking of the front wheel and down tube member of the bicycle frame. Finally, metal support spacer rods hold the panels substantially parallel and thereby define the third region into which a cable may be looped to secure a bicycle. Thus, all types of cables, chains, and "U"-shaped locks may be easily attached to the rack to secure a bicycle.

THE BEST MODE FOR CARRYING OUT THE INVENTION

Figure 1:
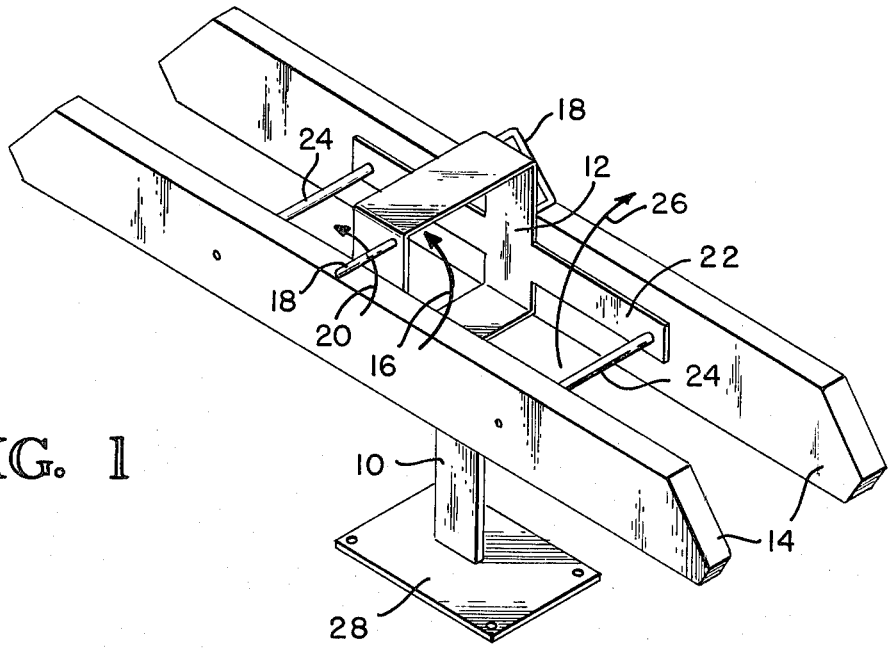
FIG. 1 is an isometric of a preferred bicycle rack of this invention.
Figure 2:
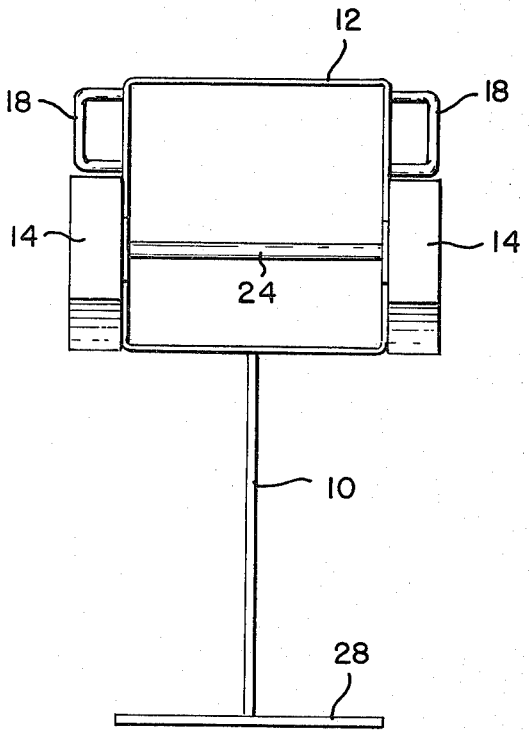
FIG. 2 is an end view of the rack of FIG. 1.

A preferred rack to which the bicycle may be conveniently locked while the bicycle and its finish are protected includes a central support 10 which projects upwardly from the ground. The top of the support 10 is fashioned into a generally rectangular loop 12 which provides the first locking loop for bicycles positioned adjacent side panels 14. The panels 14 are attached to the support 10, straddle the support, and extend substantially parallel to one another preferably at least as far as the distance between the fork and seat-stay members of the bicycle frame when the bicycle is locked to the rack. The support 10 is preferably formed from welded bar stock which is hot-dipped in a galvanized finish. The panels 14 are preferably formed from unplaned pressure treated fir 2"×6"×49" with beveled corners to increase their attractiveness. Other rigid materials which will protect the finish and equipment may be used for the panels. Coated metals are discouraged, while plastics may be desirable in some environments. The panels 14 are set so that their upper surfaces extend to about 20 inches above the ground, and serve to cushion the bicycle frame, its finish, and other bicycle equipment when a bicycle is locked to the rack. The height has been set so that a bicycle may be easily rolled into position next to the rack, with its pedal passing below the bottom edge of the panel. Arrow 16 shows how one might lock a bicycle through the upper rectangular loop 12 of the support 10.

Positioned directly above the panel 14 on each side of the support 10, a metal loop 18 provides a second locking loop for bicycles positioned adjacent the panels. Arrow 20 indicates how a "U"-shaped shackle lock may be placed around the locking loop 18. The loop 18 is especially adapted to receive shackle locks, such as those sold under the trademark "KRYPTONITE" by KBL Corporation. This "U" lock is often preferred by bicycle riders because of the security it provides. Most bicycle racks available today do not provide convenient locking means for attaching this type of lock to the rack while allowing its correct use enclosing both the bicycle wheels and frame or permitting the quick locking option described above.

The support 10 has sheet metal 22 extending horizontally from the rectangular loop 12 to provide additional support for each panel 14. Structural support rods 24 may be used to maintain the substantially parallel orientation of the two panels 14. If used, the structural support rods 24 define at least one additional locking loop through which a cable and chain may be placed while securing a bicycle. This locking loop is defined by the support, a section of one panel, the structural support rod, and a second section of the other panel. The arrow 26 indicates how this third locking loop may be used to secure a bicycle.

Various means are suitable to anchor the support 10 to the ground. As shown in FIG. 1, the support 10 may be welded to a support plate 28 which is bolted to a concrete surface. Alternatively, the support 10 may be set in poured concrete or into a core bit drilled hole, with or without a support plate. Those skilled in the art of concrete anchoring will recognize various other means by which the support 10 may be placed upon the ground.

Racks are optimally placed 48 inches apart, with each rack set parallel upon a plane defined by the outside lateral surface of the wood panels. A placement of 42 inches is the minimum recommended spacing between such parallel placed racks.

To allow easy utilization of both panels of a rack, loop 12 should be large enough that two locked bicycles straddling the rack do not contact one another even with the handlebars which project inwardly from the bicycle frames.

The bicycle rack of this invention features attractive wood in a pleasing shape which looks right in most settings. Its anchoring system can be easily adapted to solve any sighting problems. The rack has no moving parts to wear out, no painted finish to renew, and no plastic cushioning to replace. When built from pressure-treated fir and hot-dipped galvanized metal, the bicycle rack of this invention is virtually maintenance free when receiving normal use.

The bicycle rack of this invention supports a bicycle by more than just the wheels. It may accommodate just about any locking system without requiring kneeling to lock up. Bicycles having both front and rear panniers may be easily locked to this rack without requiring removal of the panniers. A bicycle rack of this invention, therefore, results in a flexible, good-looking, low maintenance system that meets everyone's needs.

I claim:

1. A rack to which a bicycle may be conveniently locked while the bicycle and its finish are protected, comprising:

(a) a support projecting upwardly from the ground;

(b) two elevated wooden panels attached to the support, laterally spaced to straddle the support, and extending substantially parallel to one another at least as far as the distance between the fork and seat-stay of the bicycle; and (c) a locking loop rigidly affixed on each side of the support capable of receiving a lock used to secure a bicycle, wherein (1) the bicycle is lockable to the rack so that the wheels of the bicycle extend substantially parallel to the panels and adjacent to the panel, and (2) the panels are sufficiently spaced so that bicycles may be simultaneously locked without interference adjacent both panels, further comprising at least one support rod extending between the panels and defining another locking loop defined by the support, a section of one panel, the rod, and a section of the second panel.

2. The rack of claim 1, further comprising a supplemental locking loop integrally fashioned into the support.

3. The rack of claim 1 wherein the panels extend substantially horizontally approximately twenty inches above the ground on their upper surfaces.

4. The rack of claim 3 wherein the panels are made from 2"×6" pressured-treated fir.

5. A rack to which a bicycle may be conveniently locked while the bicycle and its finish are protected, comprising:

(a) a support projecting upwardly from the ground and including an integral locking loop capable of receiving a lock used to secure a bicycle;

(b) two wooden panels laterally spaced above the ground to straddle the support and extending substantially parallel to one another at least as far as the distance between the fork and seat-stay frame member of the bicycle and sufficiently apart to allow two bicycles to be locked simultaneously adjacent both panels; and (c) at least one support rod extending between the panels and defining a second locking loop having its sides defined by the support, a section of one panel, the rod, and a section of the second panel, wherein the bicycle is lockable to the rack so that the wheels of the bicycle extend substantially parallel to the panel to which they are adjacent, and is locked so that the front wheel is constrained from turning.

6. The rack of claim 5 wherein the support is bar stock metal.

7. A rack to which a bicycle may be conveniently locked in a variety of positions while the bicycle and its finish are protected, comprising:

(a) a support projecting upwardly from the ground and including an integral locking loop capable of receiving a lock used to secure a bicycle;

(b) two wooden panels laterally spaced to straddle the support and extending substantially parallel to one another at least as far as the distance between the fork and seat-stay frame member of the bicycle and sufficiently apart to allow two bicycles to be locked simultaneously adjacent both panels;

(c) a locking loop on each side of the support capable of receiving a lock used to secure a bicycle;

(d) at least one support rod extending between the panels and defining a third locking loop for the rack defined by the support, a section on one panel, the rod and a section of the second panel, wherein the bicycle is lockable to the rack so that the wheels of the bicycle extend substantially parallel to the panels and adjacent to one panel with locking possible with any combination of the locking loops.

8. The rack of claim 7 wherein the panels extend substantially horizontally approximately twenty inches above the ground on their upper surfaces.

9. A rack to which a bicycle may be conveniently locked while the bicycle and its finish are protected, comprising:

(a) a support projecting upwardly from the ground;

(b) two wooden panels laterally spaced to straddle the support and extending substantially parallel to one another at least as far as the distance between the fork and seat-stay of the bicycle;

(c) a locking loop on each side of the support capable of receiving a lock used to secure a bicycle; and (d) at least one support rod extending between the panels and defining another locking loop defined by the support, a section of one panel, the rod, and a section of the second panel, wherein (1) the bicycle is lockable to the rack so that the wheels of the bicycle extend substantially parallel to the panels and adjacent to the panel and (2) the panels are sufficiently spaced so that bicycles may be simultaneously locked without interference adjacent both panels.

10. The rack of claim 9 wherein the support is bar stock metal.

11. The rack of claim 10 wherein the panels are 2"×6" pressure-treated fir.

12. The rack of claim 9 wherein the panels extend substantially horizontally approximately twenty inches above the ground on their upper surfaces.

* * * * *